US010335848B2

(12) United States Patent
Lee

(10) Patent No.: US 10,335,848 B2
(45) Date of Patent: Jul. 2, 2019

(54) PRESS-MOLDED ARTICLE MANUFACTURING SYSTEM AND METHOD FOR CHANGING PRESS MOLDS AND GRIPPERS

(71) Applicant: Miwon Precision Ind. Co., Ltd., Yesan-gun (KR)

(72) Inventor: Dae Gil Lee, Cheonan-si (KR)

( * ) Notice: Subject to any disclaimer, the term of this patent is extended or adjusted under 35 U.S.C. 154(b) by 72 days.

(21) Appl. No.: 15/719,206

(22) Filed: Sep. 28, 2017

(65) Prior Publication Data

US 2018/0021839 A1 Jan. 25, 2018

Related U.S. Application Data

(63) Continuation-in-part of application No. 14/415,132, filed as application No. PCT/KR2012/010915 on Dec. 14, 2012, now abandoned.

(30) Foreign Application Priority Data

Jul. 19, 2012 (KR) ..... 10-2012-0078667

(51) Int. Cl.
*B21D 37/14* (2006.01)
*B21D 24/00* (2006.01)
*B21D 43/05* (2006.01)

(52) U.S. Cl.
CPC ..... *B21D 37/14* (2013.01); *B21D 24/005* (2013.01); *B21D 43/05* (2013.01)

(58) Field of Classification Search
CPC ..... B23Q 3/155–15793; B21D 24/005; B21D 37/14; B21D 43/05; G05B 19/4166
See application file for complete search history.

(56) References Cited

U.S. PATENT DOCUMENTS 4,484,466 A * 11/1984 Groos ..... B21C 23/214 72/255
5,219,319 A * 6/1993 Katagiri ..... B29C 31/006 425/183
5,882,285 A * 3/1999 Seto ..... B21D 28/12 483/29
6,200,245 B1 * 3/2001 Dodo ..... B21B 15/0042 483/1
6,394,941 B2 * 5/2002 Kawamoto ..... B21D 37/14 100/224
2002/0033086 A1 * 3/2002 Kobayashi ..... B21D 28/265 83/549

FOREIGN PATENT DOCUMENTS

CA 2429896 A1 * 11/2003 ..... B21D 43/057
EP 0838278 A1 * 4/1998 ..... B21D 5/02
EP 1138413 A2 * 10/2001 ..... B21D 37/14

* cited by examiner

*Primary Examiner* — Nicole N Ramos
(74) *Attorney, Agent, or Firm* — Antonio Ha & U.S. Patent, LLC

(57) ABSTRACT

The present invention relates to an automatic press-molded article manufacturing system using a double robot line for a tandem press line and, more specifically, to an automatic press-molded article manufacturing system using a double robot line for a tandem press line, wherein a plurality of destackers and positioners are disposed, each group having two robots is separately disposed and moves alternately, so as to continuously and rapidly transfer and supply the raw material in proportion to a press working time, in a raw material transfer process, a material supply process, an article supply process, and a product withdrawal process.

4 Claims, 5 Drawing Sheets

PRESS-MOLDED ARTICLE MANUFACTURING SYSTEM AND METHOD FOR CHANGING PRESS MOLDS AND GRIPPERS

CROSS-REFERENCE TO RELATED APPLICATIONS

This patent application is a continuation-in-part of U.S. patent application Ser. No. 14/415,132, filed on Jan. 15, 2015, which is a national-stage application of PCT/KR2012/010915, filed on Dec. 14, 2012, which claims priority under 35 U.S.C. § 119 to Korean Patent Application No. 10-2012-0078667, filed on Jul. 19, 2012, in the Korean Intellectual Property Office, the disclosure of which is incorporated by reference herein in its entirety.

TECHNICAL FIELD

The present invention relates to an automatic press-molded article manufacturing system using a double robot line for a tandem press line, and more specifically, to an automatic press-molded article manufacturing system using a double robot line for a tandem press line, and a method for exchanging press molds and grippers in an automatic press-molded article manufacturing system using a double robot line for a tandem press line.

DISCUSSION OF RELATED ART

Press molding is a technique in which, a raw material, e.g., an iron plate, is forced into a mold in order to take the shape of the mold. Conventionally, the process has been conducted manually by people, but is now being automated for higher productivity and lower occurrence of industrial accidents.

A recently developed automatic manufacturing system adopts multi-axis driving robots to carry raw materials or press-molded articles from one processing stage to another.

Such conventional system is deployed so that each one of the multi-axis driving robots is positioned between two neighboring ones of multiple presses, overall configuring a single raw material supply line. Press molding by the presses is done relatively faster than the transfer or supply by the robots. Thus, the presses may be left idle until they are reloaded by the robots, resulting in a poor yield of final products.

SUMMARY

The present invention has been conceived to address the above issues, and an object of the present invention is to provide an automatic press-molded article manufacturing system using a double robot line for a tandem press line, which includes a plurality of destackers, a plurality of positioners, and pairs of robots for transferring and supplying raw materials and press-molded articles and carrying out the press-molded articles, each robot pair having two robots positioned apart from each other. The paired robots may alternately move, accelerating the stages of supplying and transferring the raw materials or press-molded articles to catch up with the processing stages by the presses. Thus, a higher yield of final products may be obtained.

Since each pair of robots is in charge of its respective stage of supplying, transferring, and carrying out the raw materials or press-molded articles, one of the paired robots may function as a redundancy in preparation of when the other breaks down, which allows the system into a seamless operation.

According to the present invention, an automatic press-molded article manufacturing system using a double robot line for a tandem press line comprises: a plurality of destackers positioned apart from each other at a predetermined distance and loaded with multiple raw materials, a pair of raw material transfer robots transferring the raw materials loaded on the destackers while holding the raw materials by suction, a plurality of positioners positioned between the raw material transfer robots to position the raw materials transferred by the raw material transfer robots, a pair of raw material supply robots positioned apart from each other behind the raw material transfer robots and alternately moving to supply the raw materials from the positioners to a press while holding the raw materials by suction, a plurality of presses sequentially positioned behind the raw material supply robots and press-molding the raw materials received from the raw material supply robots into press-molded articles, a plurality of pairs of press-molded article supply robots, each pair of press-molded article supply robots positioned between a first press and a second press of the plurality of presses and alternately moving to supply the press-molded articles from the first press to the second press, wherein the press-molded article supply robots in each pair is spaced apart from each other, a pair of product carrying-out robots positioned apart from each other behind a rear-most press of the presses and alternately moving to carry out final press-molded articles, and a controller configured to control the raw material transfer robots, the raw material supply robots, the presses, the press-molded article supply robots, and product carrying-out robots.

According to the present invention, an automatic press-molded article manufacturing system using a double robot line for a tandem press line includes a plurality of destackers, a plurality of positioners, and pairs of robots for transferring and supplying raw materials and press-molded articles and carrying out the press-molded articles, each robot pair having two robots positioned apart from each other. The paired robots may alternately move, accelerating the stages of supplying and transferring the raw materials or press-molded articles to catch up with the processing stages by the presses. Thus, a higher yield of final products may be obtained.

Since each pair of robots is in charge of its respective stage of supplying, transferring, and carrying out the raw materials or press-molded articles, one of the paired robots may function as a redundancy in preparation of when the other breaks down, which allows the system into a seamless operation.

According to an embodiment of the present invention, a method for exchanging press molds and grippers in an automatic press-molded article manufacturing system using a double robot line for a tandem press line comprises receiving, from a controller, an exchange signal to change a first press mold and a first gripper, stopping a gripping task for carrying a raw material and a pressing process performed on a first raw material according to the exchange signal, automatically changing the first gripper to a second gripper, automatically changing the first press mold to a second press mold simultaneously with changing the first gripper to the second gripper, transferring a second raw material using the second gripper, and performing the pressing process on the second raw material using the second press mold, wherein the system includes a first press, a second press positioned behind the first press, and a third press positioned behind the second press, wherein the steps are performed on the second press independently from the first press, and the steps are performed on the third press independently from the first press and the second press, and wherein the pressing process, the step of changing the first press mold to the second press mold, and the step of changing the first gripper to the second gripper are continuously performed through the first press, the second press, and the third press.

According to an embodiment of the present invention, the step of changing the first gripper to the second gripper may include the steps of moving down a robot safety door attached to a rotating table with the second gripper, moving a raw material supply robot with the first gripper to the rotating table, attaching the first gripper to the rotating table and then removing the first gripper from the raw material supply robot, after attaching the second gripper to the raw material supply robot 4, disconnecting the second gripper from the rotating table, moving the raw material supply robot with the second gripper to a position for the gripping task, and moving up the robot safety door.

According to an embodiment of the present invention, the step of changing the first press mold to the second press mold may include the steps of, after moving down a slide of one of the first press, the second press, and the third press, releasing a mold fastening clamp for the first press mold, moving up a press safety door, pulling the first press mold out of a mold exchanger while putting the second press mold in the mold exchanger, fastening the second press mold with the mold fastening clamp while moving up the slide, and moving down the press safety door.

According to an embodiment of the present invention, the step of changing the first press mold to the second press mold for the first press having a die cushion may include the steps of discharging air from the die cushion of the first press between the step of releasing the mold fastening clamp and the step of moving up the press safety door and putting air in the die cushion of the first press between the step of fastening with the mold fastening clamp and the step of moving up the press safety door.

According to an embodiment of the present invention, carrying the raw material may be performed simultaneously with the step of fastening with the mold fastening clamp.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DESCRIPTION OF EXEMPLARY EMBODIMENTS

According to the present invention, an automatic press-molded article manufacturing system using a double robot line for a tandem press line comprises a plurality of destackers positioned apart from each other at a predetermined distance and loaded with multiple raw materials, a pair of raw material transfer robots transferring the raw materials loaded on the destackers while holding the raw materials by suction, a plurality of positioners positioned between the raw material transfer robots to position the raw materials transferred by the raw material transfer robots, a pair of raw material supply robots positioned apart from each other behind the raw material transfer robots and alternately moving to supply the raw materials from the positioners to a press while holding the raw materials by suction, a plurality of presses sequentially positioned behind the raw material supply robots and press-molding the raw materials received from the raw material supply robots into press-molded articles, a plurality of pairs of press-molded article supply robots, each pair of press-molded article supply robots positioned between a first press and a second press of the plurality of presses and alternately moving to supply the press-molded articles from the first press to the second press, wherein the press-molded article supply robots in each pair is spaced apart from each other, a pair of product carrying-out robots positioned apart from each other behind a rearmost press of the presses and alternately moving to carry out final press-molded articles, and a controller configured to control the raw material transfer robots, the raw material supply robots, the presses, the press-molded article supply robots, and product carrying-out robots.

Hereinafter, preferred embodiments of the present invention are described in detail with reference to the accompanying drawings.

Figure 1:
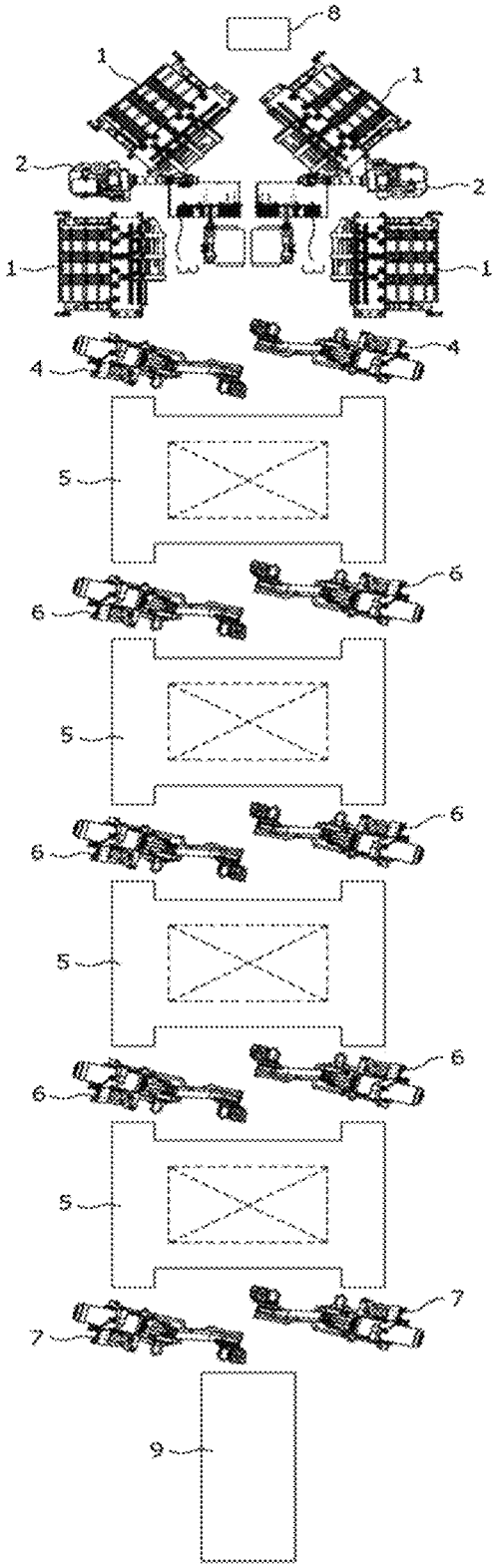
FIG. 1 is a plan view illustrating a deployment of an automatic press-molded article manufacturing system using a double robot line for a tandem press line, according to an embodiment of the present invention.
Figure 2:
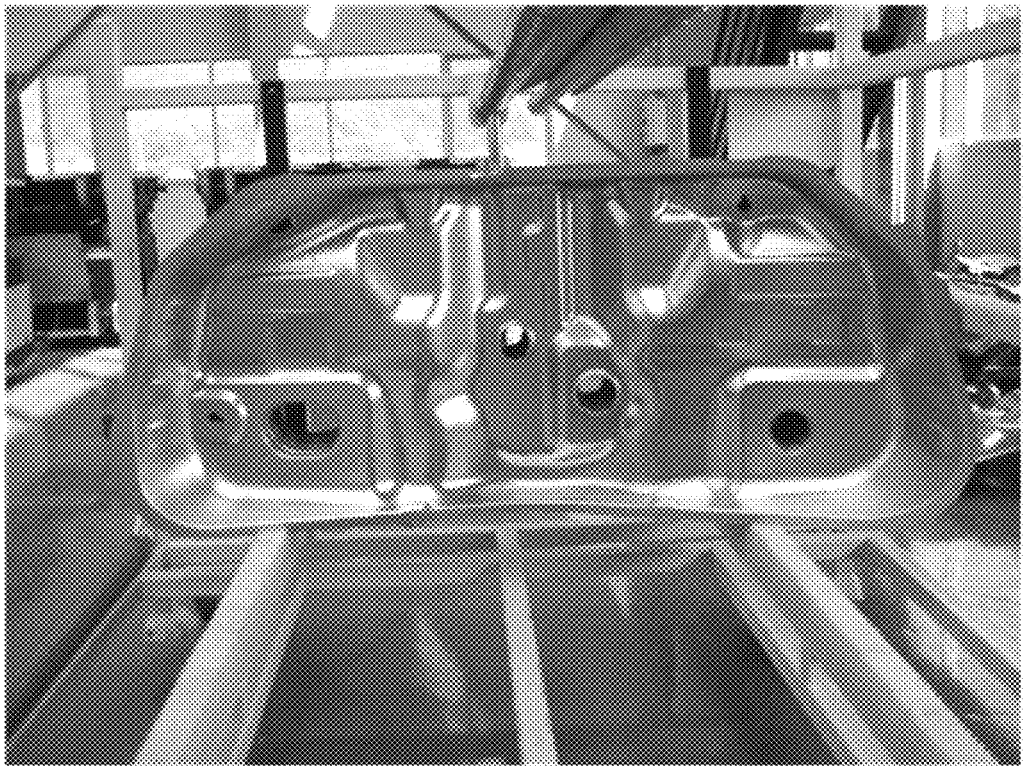
FIG. 2 is a view illustrating a product manufactured by an automatic press-molded article manufacturing system using a double robot line for a tandem press line, according to the present invention.

FIG. 1 is a plan view illustrating a deployment of an automatic press-molded article manufacturing system using a double robot line for a tandem press line, according to the present invention. FIG. 2 is a view illustrating a product manufactured by an automatic press-molded article manufacturing system using a double robot line for a tandem press line, according to the present invention.

Referring to FIGS. 1 and 2, the automatic press-molded article manufacturing system using a double robot line for a tandem press line, according to the present invention, includes destackers 1, raw material transfer robots 2, positioners 3, raw material supply robots 4, presses 5, press-molded article supply robots 6, product carrying-out robots 7, and a controller 8.

According to the present invention, the manufacturing process including transferring and supplying raw materials, pressing, and carrying out products may be performed under automatic control, not on manual, thus enabling a yield of about twenty press-molded articles per minute. The transfer and supply of raw materials, pressing, and carry-out of press-molded articles may be continuously conducted, thus leading to a reduced manufacturing time together with a significantly increased yield of products.

Provided are a plurality of destackers 1 that are arranged apart from each other at a predetermined distance and that use, e.g., a forklift, to load multiple metallic materials thereon.

The plurality of destackers 1, respectively, are positioned adjacent to the plurality of raw material transfer robots 2. A first one of the destackers 1 is positioned at a rear side of one of the raw material transfer robots 2, and a second one of the destacker 1 is positioned at a front side of the other raw material transfer robot 2, thus free from mutual interference when the raw material transfer robots 2 are in operation. However, the deployment may be varied without being limited thereto. Two more destackers 1 (third and fourth destackers) may be provided in preparation for the exhaustion of the ram materials loaded on the first and second destackers 1. The third and fourth destackers 1 are positioned to respectively correspond to the first and second destackers 1. The destackers 1 arranged at the front sides of the raw material transfer robots 2 preferably form an angle of about 30 to about 45 degrees therebetween, so as to avoid interference between the raw material transfer robots 2.

The destackers 1 are hydraulic equipment that are put in wide use. Each destacker 1 includes a support elevating means and multiple rollers on the top on which raw materials are loaded. As the raw materials are sequentially supplied and thus run out, the support elevating means of the destacker ascends.

The raw material transfer robots 2 are provided in pair. The pair of raw material transfer robots 2 are spaced apart from each other. The raw material transfer robots 2 transfer the raw materials loaded on the destackers 1, while holding the raw materials by suction.

The raw material transfer robots 2 and all the other robots to be described below are equipment for transferring and supplying metallic materials or press-molded articles, and each may have multiple axes. The robots may be industrial robots that may be operated under the control of the controller 8. The robots are being widely used in electronic or machine industries, and thus, detailed descriptions thereof are omitted.

The plurality of positioners 3 are arranged between the raw material transfer robots 2, and the positioners 3 place, thereon, the raw materials transferred by the raw material transfer robots 2. For example, the positioners 3 are installed in an operation range of the raw material transfer robots 2, in which the raw materials may be transferred by the raw material transfer robots 2. Each positioner 3 includes a plurality of vertical legs and an upper table plate that is supported by the vertical legs. The upper table plate is inclined inward and downward. The inclined angle of the positioners 3 is preferably about 10 degrees to about 45 degrees.

Each positioner 3 primarily plays a role to place the raw materials in position to fit the operation range of the robot stationary at a side thereof so that the robot may transfer the raw materials to a predetermined position between the upper and lower pieces of mold of its corresponding press 5, with the raw materials suctioned to the raw material transfer robot 2.

Specifically, the raw materials carried from the destackers 1 to the upper portions of the positioners 3 by the raw material transfer robots 2 slide down along the edges of the positioners 3 and are thus placed in position. The raw materials may be then supplied from the positioners 3 to predetermined positions of the presses 5 by the raw material supply robots 4.

The raw material supply robots 4 are provided in pair. The pair of raw material supply robots 4, respectively, are positioned at the respective rear sides of the raw material transfer robots 2. The raw material supply robots 4 alternately move, holding the raw materials on the positioners 3 by suction and supplying the raw materials to the presses 5. Each raw material supply robot 4 may include a hollow or curved part (not shown) (hereinafter, collectively referred to as a 'curved part') in a lower body thereof to protect the raw material and to reduce disturbance due to the alternate movement or operation. Each raw material supply robot 4 may suck up the raw material from the positioner 3 using a gripper G and move the raw material to the press 5 while passing the curved part.

As such, a pair of raw material supply lines, each including a raw material transfer robot, a raw material supply robot 4, a plurality of destackers 1, and a positioner 3, may be built up, resulting in a higher yield as compared with the conventional art.

A plurality of presses 5 are sequentially arranged behind the raw material supply robots 4. The foremost press of the presses 5 receives the raw materials from the raw material supply robots 4 and forces the raw materials into a mold to form the raw materials into press-molded articles of desired shapes.

Although four presses 5 are shown in FIG. 1, more presses 5 may be provided depending on types or shapes of final press-molded articles. The presses 5 may be controlled by the controller 8 and by their own respective manual controllers.

The press-molded article supply robots 6 are provided in pairs. Each pair of press-molded article supply robots 6 are spaced apart from each other between the presses 5. The press-molded article supply robots 6 alternately move, supplying the press-molded articles from one press to another.

The press-molded article supply robots 6 are arranged corresponding to each other in a space between the presses 5 respectively for first and second forming stages, and the press-molded article supply robots 6 may continuously supply the article formed by the press 5 for the first forming stage to the press 5 for the second forming stage.

The product carrying-out robots 7 are provided in pair. The pair of product carrying-out robots 7 are spaced apart from each other. The product carrying-out robots 7 are positioned behind the rearmost press 5 of the presses 5. The product carrying-out robots 7 alternately move, carrying out the final press-molded articles. A conveyor 9 is preferably provided between the product carrying-out robots 7 to guide the conveyance of the final press-molded articles.

The controller 8 controls the operation of the raw material transfer robots 2, the raw material supply robots 4, the presses 5, the press-molded article supply robots 6, and the product carrying-out robots 7. The controller 8 may be placed in a separate control room at the foremost side of the system to keep out of reach of others except the worker.

Now described is a process for manufacturing a press-molded article by an automatic press-molded article manufacturing system using a double robot line for a tandem press line according to the present invention.

According to an embodiment of the present invention, a method for exchanging press molds and grippers in an automatic press-molded article manufacturing system using a double robot line for a tandem press line may comprise receiving, from a controller, an exchange signal to change a first press mold and a first gripper, stopping a gripping task for carrying a raw material and a pressing process performed on a first raw material according to the exchange signal, automatically changing the first gripper to a second gripper, automatically changing the first press mold to a second press mold simultaneously with changing the first gripper to the second gripper, transferring a second raw material using the second gripper, and performing the pressing process on the second raw material using the second press mold, wherein the system includes a first press, a second press positioned behind the first press, and a third press positioned behind the second press, wherein the steps are performed on the second press independently from the first press, and the steps are performed on the third press independently from the first press and the second press, and wherein the pressing process, the step of changing the first press mold to the second press mold, and the step of changing the first gripper to the second gripper are continuously performed through the first press, the second press, and the third press.

According to an embodiment of the present invention, the step of changing the first gripper to the second gripper may include the steps of moving down a robot safety door attached to a rotating table with the second gripper, moving a raw material supply robot with the first gripper to the rotating table, attaching the first gripper to the rotating table and then removing the first gripper from the raw material supply robot, after attaching the second gripper to the raw material supply robot 4, disconnecting the second gripper from the rotating table, moving the raw material supply robot with the second gripper to a position for the gripping task, and moving up the robot safety door.

According to an embodiment of the present invention, the step of changing the first press mold to the second press mold may include the steps of, after moving down a slide of one of the first press, the second press, and the third press, releasing a mold fastening clamp for the first press mold, moving up a press safety door, pulling the first press mold out of a mold exchanger while putting the second press mold in the mold exchanger, fastening the second press mold with the mold fastening clamp while moving up the slide, and moving down the press safety door.

According to an embodiment of the present invention, the step of changing the first press mold to the second press mold for the first press having a die cushion may include the steps of discharging air from the die cushion of the first press between the step of releasing the mold fastening clamp and the step of moving up the press safety door and putting air in the die cushion of the first press between the step of fastening with the mold fastening clamp and the step of moving up the press safety door.

According to an embodiment of the present invention, carrying the raw material may be performed simultaneously with the step of fastening with the mold fastening clamp.

First, a pair of raw material transfer robots 2 individually transfer the raw materials loaded on the destackers 1 to the positioners 3.

The raw materials transferred to the positioners 3 are alternately supplied to the foremost press 5 by a pair of raw material supply robots 4.

The raw materials are formed into a predetermined shape by the foremost press 5, and the resultant articles are then supplied to a next press 5 for a subsequent stage by a pair of press-molded article supply robots 6. In this case, the number of presses 5 may be not less than two and not more than N (N is a natural number). As the number of forming stages by the presses 5 increases, more presses 5 may be needed.

While one of the paired robots 6 transfers a press-molded article from a first press 5 for a first forming stage to a second press 5 for a second forming stage subsequent to the first forming stage, while holding the press-molded article by suction, the other robot 6, after unloading another press-molded article to the second press 5, returns to the first press 5, empty-handed, for another transfer. As such, the paired robots 6 alternately transfer and supply press-molded articles to a next forming stage while moving in opposite directions thereof, significantly reducing transfer time.

Having undergone the multiple forming stages by the presses 5 for desired shapes, the final press-molded articles are guided via the rearmost press 5 to the conveyor 9 by the product carrying-out robots 7, and are then carried out by the conveyor 9.

Now described is a method for exchanging press molds and grippers in an automatic press-molded article manufacturing system using a double robot line for a tandem press.

Figure 3:
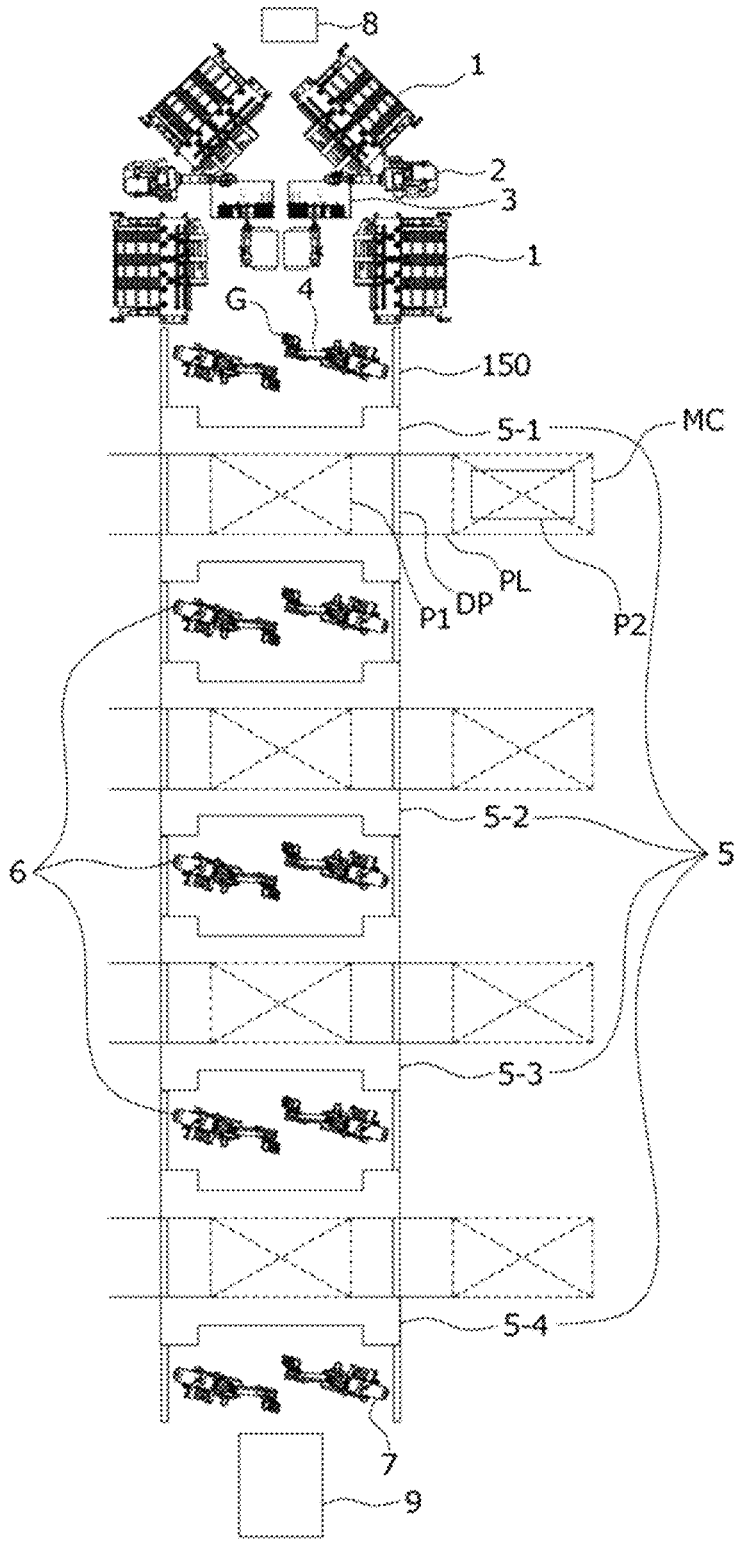
FIG. 3 is a plan view illustrating a deployment of an automatic press-molded article manufacturing system using a double robot line for a tandem press line, according to an embodiment of the present invention.
Figure 4:
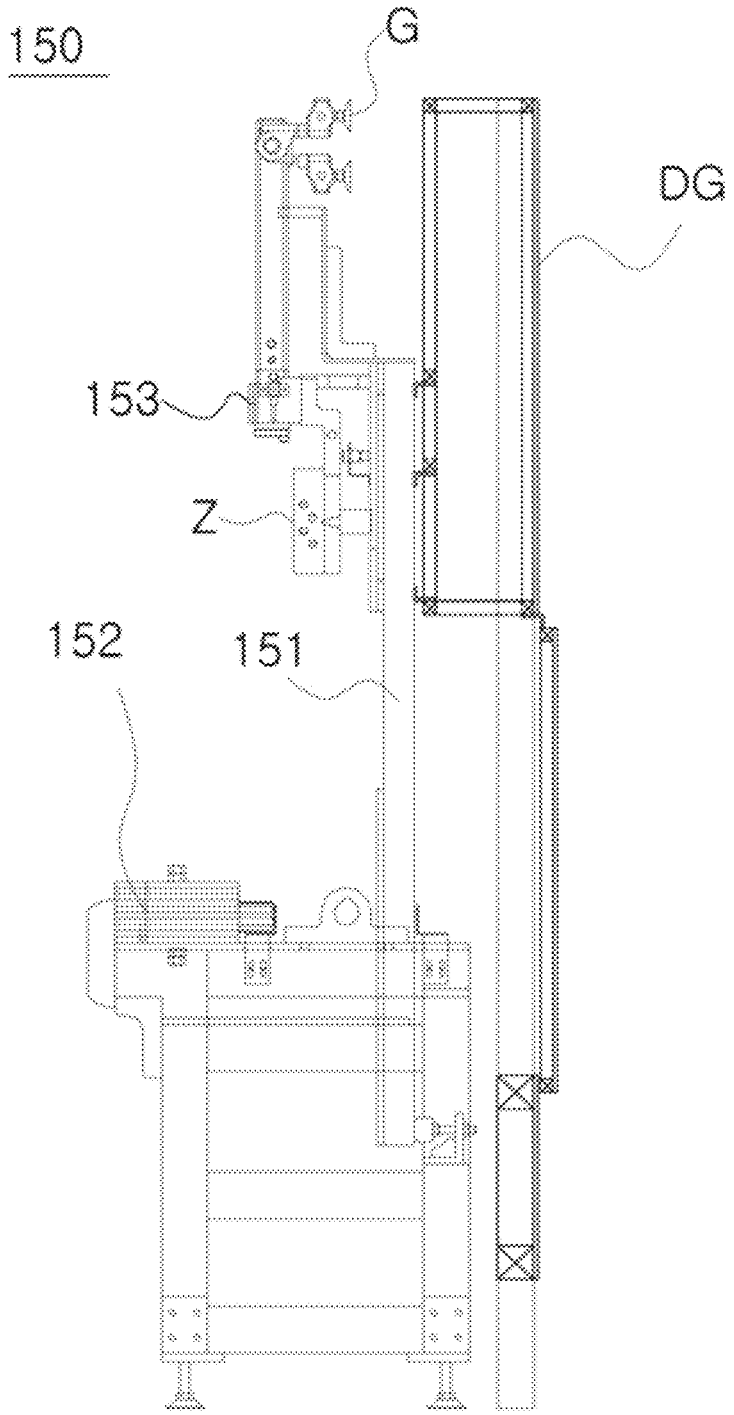
FIG. 4 is a side view illustrating an automatic gripper exchanger in an automatic press-molded article manufacturing system using a double robot line for a tandem press line, according to an embodiment of the present invention.

FIG. 3 is a plan view illustrating a deployment of an automatic press-molded article manufacturing system using a double robot line for a tandem press line, according to an embodiment of the present invention. FIG. 4 is a side view illustrating an automatic gripper exchanger in an automatic press-molded article manufacturing system using a double robot line for a tandem press line, according to an embodiment of the present invention.

According to an embodiment of the present invention, an automatic press-molded article manufacturing system (hereinafter, simply "system") using a double robot line for a tandem press may include destackers 1, raw material transfer robots 2, positioners 3, raw material supply robots 4, presses 5, press-molded article supply robots 6, product carrying-out robots 7, a controller 8, a conveyor 9, and gripper exchangers 150.

The destackers 1, raw material transfer robots 2, positioners 3, raw material supply robots 4, presses 5, press-molded article supply robots 6, product carrying-out robots 7, controller 8, and conveyor 9 may be substantially the same as those described and shown in connection with FIGS. 1 and 2.

All of the other components of the system than the press 5, conveyor 9, and controller 8 may be configured on double lines, enabling more production within a shorter time.

According to an embodiment of the present invention, two gripper exchangers 150 may be provided along the double lines. The gripper exchangers 150 may be spaced apart from each other at a predetermined interval and face each other. The raw material supply robots 4 may be disposed between the gripper exchangers 150.

Referring to FIG. 4, each gripper exchanger 150 may include a rotating table 151, a driving means 152, and a locking unit 153.

The rotating table 151 may be rendered to ascend or descend by the driving means 152 that is driven by the controller 8. A safety door DG may be coupled with the rotating table 151 to restrict a worker or others from entry, leading to the process safely proceeding and enabling efficient use of the work space. The safety door DG, together with the rotating table 151, may be rendered to ascend or descend by a driving signal from the controller 8.

The locking unit 153 may be installed on the rotating table 151 to hook or fasten a gripper G. The locking unit 153 may interwork with a fastening jig Z that is positioned at a side of the gripper G, so that the gripper G is disconnected from the rotating table 151 when the raw material supply robot 4 is coupled to the gripper G through the fastening jig G.

At least two or more locking units 153 that are spaced apart from each other may be provided on the rotating table 151 to hold multiple grippers G. The grippers G may automatically be exchanged without the work's involvement while performing a pressing process.

The presses 5 may include a first press 5-1, a second press 5-2, a third press 5-3, and a fourth press 5-4 that are arranged in sequence behind the raw material supply robots 4.

According to an embodiment of the present invention, one raw material supply robot 4 or a pair of raw material supply robots 4 may be disposed ahead of the first press 5-1. When a pair of raw material supply robots 4 are provided, the raw material supply robots 4 are alternately driven to supply raw materials to the first press 5-1.

Mold exchangers PL may be arranged along each row or line of the presses 5 to automatically exchange press molds. A mold carrier MC may be provided at a side of each mold exchanger PL. A press mold P2 may be placed on the mold carrier MC and carried by the mold carrier MC to the mold exchanger PL.

The press mold P2 may be guided to be in line with a press mold P1 which is in work.

A safety door DP may be provided between two opposite sides of each press 5. The safety s15 door DP may be driven by a driving signal from the controller 8.

The safety door DP may be provided to protect the work during the pressing process while enabling efficient use of the working space.

The pair of product carrying-out robots 7 may be arranged behind the fourth press 5-4. The product carrying-out robots 7 may alternately move and deliver products to the conveyor 9.

The products conveyed on the conveyor 9 may be examined by the worker.

As described above, the raw material supply robots 4, presses 5, press-molded article supply robots 6, or product carrying-out robots 7 may be provided in pair, and the pair of robots may alternately be operated.

For example, the press-molded article supply robot 6 may include a pair of press-molded article supply robots 6 that may include a first press-molded article supply robot 6 and a second press-molded article supply robot 6. When the first press-molded article supply robot 6 holds up a product on the first press 5-1 by, e.g., suction, the second press-molded article supply robot 6 loads a product on the second press 5-1. Then, the first press-molded article supply robot 6 may carry the product over onto the second press 5-2, and the second press-molded article supply robot 6 may be moved over to the first press 5-1 to hold another product. Such operations of the first press-molded article supply robot 6 and the second press-molded article supply robot 6 may alternately be performed. Such alternate operations of the first and second press-molded article supply robots 6 may also apply to the other robots, e.g., the other press-molded article supply robots 6, the raw material supply robots 4, and the product carrying-out robots 7. According to an embodiment of the present invention, each robot 4, 5, 6, and 7 may pivotally be moved with respect to a vertical axis thereof.

For example, the raw material supply robots 4 may be moved or pivoted in opposite directions from each other, enabling seamless process and resultantly an enhanced throughput within a reduced time. Such operations of the raw material supply robots 4 may also apply to the other robots, e.g., the other press-molded article supply robots 6 and the product carrying-out robots 7.

Exchanging grippers G or press molds may be performed automatically and simultaneously with the operations of the robots 4 to 7 under the control of the controller 8, thereby enabling it to quickly be ready to form other product.

Figure 5:
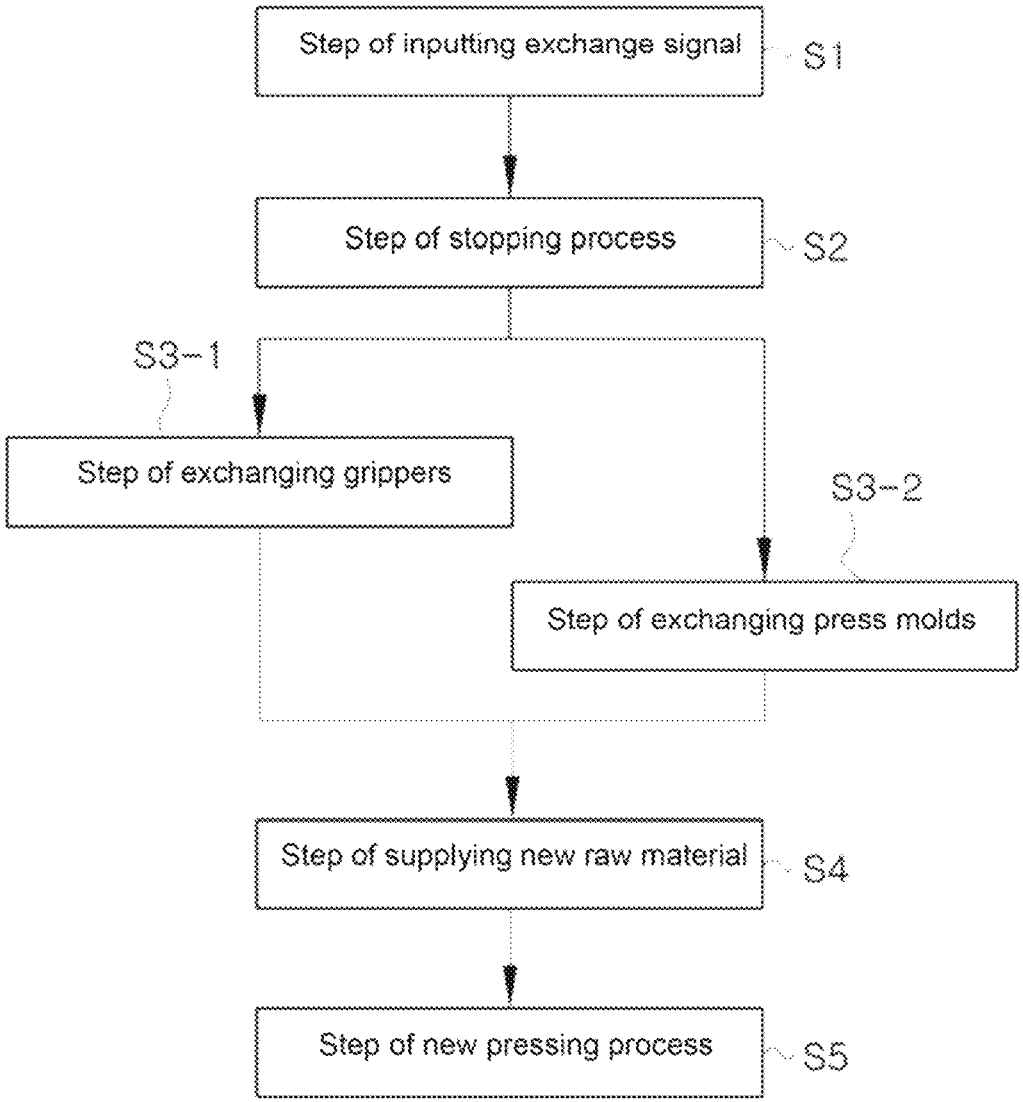
FIG. 5 is a flowchart illustrating a method for exchanging press molds and grippers in an automatic press-molded article manufacturing system using a double robot line for a tandem press line, according to an embodiment of the present invention.

FIG. 5 is a flowchart illustrating a method for exchanging press molds and grippers in an automatic press-molded article manufacturing system using a double robot line for a tandem press line, according to an embodiment of the present invention.

Referring to FIG. 5, the method may include the step S1 of inputting an exchange signal, the step S2 of stopping a process, the step S3-1 of exchanging grippers G, the step S3-2 of exchanging press molds, the step S4 of carrying a raw material, and the step S5 of starting a pressing process.

In step S1, an exchange signal for changing the press mold P1 and gripper G that are currently in process is received from the controller 8.

For example, the controller 8 sends the exchange signal to the system 100 to change the press mold P1 or gripper G to a new one under the control of a manager or for a predetermined time. According to an embodiment of the present invention, changing press molds and grippers G may simultaneously be performed by the exchange signal.

In step S2, the system 100 stops the process that is in progress with the current press mold and gripper according to the exchange signal.

The raw material transfer robots 2 stops supplying raw materials from the destackers 1 and wait for another instruction or signal (which may be referred to as a standby state). In the standby state, the first press 5-1 which has completed the process on a raw material may also be stopped by the exchange signal, and another raw material may be supplied from the destacker 1 to the positioner 3 by the raw material transfer robot 2, and the raw material transfer robot 2 then waits. When exchanging press molds on the first press 5-1 is complete, the raw material supply robots 4 start supplying raw materials, and the raw material transfer robots 2 continuously resume their operations.

Each raw material transfer robot 2 may include a raw material transfer (not shown). The raw material transfer robot 2 may use the raw material transfer (not shown) to automatically identify the shape, size, and center of the raw material and transfer the raw material by suction. The raw material transfer robot 2 may move up or down to suck up and carry only a single piece of raw material.

The press 5, e.g., the first press 5-1 which has complete the pressing process on the raw material previously supplied from the raw material supply robot 4, waits without no further processing according to the exchange signal.

In step S3-1, the gripper G with which the process has been done may automatically be changed to a new one G.

According to an embodiment of the present invention, step S3-1 may include the step S3-11 of moving down the robot safety door, the step S3-12 of driving the raw material supply robots 4, the step S3-13 of removing the gripper, the step S3-14 of fastening a new gripper G, the step S3-15 of preparing for a process with the new gripper G, and the step S3-16 of moving up the robot safety door.

In step S3-11, the robot safety door DG of the gripper exchanger 150 may descend. The rotating table 151 may be attached to the robot safety door DG. A new gripper G may be mounted on the rotating table 151. The raw material supply robot 4 waits with the old gripper G mounted thereon.

In step S3-12, the raw material supply robot 4 with the old gripper G may be moved to the rotating table 151.

The two opposite raw material supply robots 4 which are spaced apart from each other may be designed to simultaneously move without colliding with each other when the robot safety doors DG on the sides of the raw material supply robots 4 have fully been moved down and closed.

The time during which the raw material supply robots 4 move towards the robot safety doors DG may be set by a manager within a predetermined range where no collision occurs between the raw material supply robots 4, and is not particularly limited.

In step S3-13, the old gripper G is attached to the rotating table 151 and removed from the raw material supply robot 4. The old gripper G may be attached to the rotating table 151 by, e.g., hooking. When the old gripper G is attached to the rotating table 151, the fastening jig Z between the gripper G and the raw material supply robot 4 is vertically released by the locking unit 153, removing the gripper G from the raw material supply robot 4.

In step S3-14, the old gripper G is automatically changed to a new gripper G.

The raw material supply robot 4 moves to the new gripper G on the rotating table 151 and is then coupled to the fastening jig Z for the new gripper G, and the rotating table 151 accordingly releases the new gripper G that are hooked thereto.

In step S3-15, the raw material supply robot 4 with the new gripper G moves to a position for processing and waits to carry a new raw material.

The raw material supply robot 4 with the new gripper 4 moves to position the new gripper G inside the curved body part thereof, carries a new raw material form the positioner 3 up to the entrance of the press 5, and then waits. The opposite raw material supply robot 4 waits in the position of the curved body part after having carried a raw material. The downstream raw material supply robot 4 waits in the position for carrying a raw material on the upstream press 5, and its opposite raw material supply robot 4 waits in the position of the curved body part. When the press completely exchanging press molds, the raw materials start being supplied by the raw material supply robots 4, resuming the process.

In step S3-16, the robot safety door DG of the gripper exchanger 150 ascends. The robot safety door DG, together with the rotating table 151, may be vertically moved up, securing the worker's safety and working space.

Steps S3-11, S3-12, S3-13, S3-14, S3-15, and S3-16 of step S3-1 may automatically be performed in a predetermined order of time under the control of the controller 8. While step S3-1 is performed, exchanging press molds may automatically be performed on the press 5.

According to an embodiment of the present invention, step S3-2 may include the step of S3-21 of releasing a clamp, the step S3-22 of moving up a safety door, the step S3-23 of automatically exchanging press molds, the step S3-24 of fastening the clamp, and the step S3-25 of moving down the safety door.

In step S3-21, after a slide (not shown) of the press 5 descends, a clamp (not shown) for fastening the old press mold may be released.

According to the exchange signal from the controller 8, the press 5 which has finished the latest pressing process waits for exchanging with the new process mold which is placed on the mold exchanger PL.

The press 5 exchanges press molds when the raw material supply robots 4 which are positioned ahead and behind the press 5 pass a wait position for exchange after having finished their tasks. While the rotating table 151 is opened, and the raw material supply robot 4 moves to exchange with a new gripper, the slide may be moved down to release the old press mold, and the clipper which used to be coupled with the old press mold may be released.

In step S3-22, the press safety door DP disposed in the press 5 ascends. While the press safety door DP ascends, the raw material supply robot 4 may move to the rotating table 151 to remove the old gripper G.

In step S3-23, the mold carrier MC may pull out the old press mold from the mold exchanger PL and push in a new press mold to the mold exchanger PL.

The press 5 may release a moving clamp (not shown), that may be installed on the floor, to allow the moving carrier MC loading the old press mold to move. The old press mold and the new press mold may be moved in or out by the moving carrier MC on the press 5 under the control of the controller 8.

When the new press mold is positioned in place on the press 5, the moving clamp (not shown) may be operated to fasten the moving carrier MC, leaving the new press mold in a fixed work position.

In step S3-24, the slide of the press 5 may descend, the new press mold may be fastened by the mold fastening clamp, and the upper part of the press mold may be lifted up by the slide.

While the press 5 fastens the upper part of the new press mold, the raw material supply robot 4, which has already finished exchanging grippers G, is waiting in the position of the curved body part of the raw material supply robot 4 at the entrance of the press 5, with a raw material attached thereto.

In step S3-25, the press safety door DP is moved down to secure the worker's safety and work space. When the press safety door DP is closed, and the press is positioned at its top dead center, the controller 8 may determine that exchanging press molds and grippers have been complete to enable the raw material supply robot 4 to supply a raw material to the press 5.

In step S4, a raw material is delivered to the new gripper G.

The raw material supply robot 4 may suck up the raw material, which has been placed by the raw material transfer robot 2 on the positioner 3, to the new gripper G and supplies the raw material to the press 5 alternately with its opposite raw material supply robot 4.

For example, step S4 may have already been carried out while the new press mold is mounted on the press 5 as described above in connection with steps S3-15 and S3-24.

Thus, raw materials may be supplied by the raw material supply robots 4 without time delay immediately after exchanging press molds and grippers, enhancing production efficiency.

In step S5, a pressing process using the new press mold may be initiated to form the raw material carried by the raw material supply robot 4 into a product. When the exchange of press molds is individually complete, the processing process may automatically commence. Accordingly, the press which has complete the exchange of press molds may proceed with the process although the press behind is performing its existing process or exchanging press molds, enabling continuous production and resultantly enhanced processing efficiency.

According to an embodiment of the present invention, step S3-1 and step S3-2 may automatically and simultaneously be carried out, reducing the time during which the press line stops operation.

According to an embodiment of the present invention, step S4 may get it ready to supply a new raw material while step S3-24, which is a sub step of step S3-2, proceeds, which allows for an automated forming process on top of automated exchange of press molds and grippers, thereby leading to a higher throughput.

According to an embodiment of the present invention, step S3-2 and step S3-1 may automatically and simultaneously be performed under the control of the controller 8, eliminating the need for personnel for exchanging press molds and grippers.

Now described is an example of a method for simultaneously exchanging press molds and grippers in an automatic press-molded article manufacturing system using a double robot line for a tandem press line, according to an embodiment of the present invention.

The present method may be substantially the same as the method described above in connection with FIGS. 3 to 5 except for exchanging press molds in the first press 5-1, and thus, the description focuses primarily to the differences.

The first press 5-1 may include a die cushion (not shown) under the press mold and a die cushion driver for sucking in or discharging air to mitigate impacts that may arise while a pressing process proceeds.

For example, for the purpose of forming a raw material into a shape closer to an intended product at an earlier stage of the process, a heavier press mold may be mounted on the first press 5-1, which is the first to perform a pressing process, than on the other presses, e.g., the second to fourth presses 5-2, 5-3, and 5-4.

The die cushion may be installed to relieve the load applied to the first press 5-1 by the heavy press mold.

According to an embodiment of the present invention, a method for exchanging press molds for the first press 5-1 may include the step of releasing the clamp, the step of exhausting the die cushion, the step of moving up the safety door, the step of automatically exchanging press molds, the step of fastening the clamp, the step of putting air in the die cushion, and the step of moving down the safety door.

In the step of exhausting the die cushion, the air may be pulled out of the die cushion of the first press 5-1 to release the physical cushion between the upper and lower parts of the press mold that has been done with the process by the die cushion driver.

In the step of putting air in the die cushion, after a new press mold is positioned in place, air may be put in the die cushion of the first press 5-1 to provide a physical cushion between the upper and lower parts of the new press mold by the die cushion driver.

According to an embodiment of the present invention, the step of exhausting the die cushion and the step of putting air in the die cushion may further be performed for the first press 5-1, taking it longer to exchange press molds for the first press 5-1 than the other presses, e.g., the second to fourth presses 5-2, 5-3, and 5-4.

For example, when the same or more weight of press mold that that used for the first press 5-1 is used for the second to fourth presses 5-2, 5-3, and 5-4, the same method given for the first press 5-1 may be applied to exchange press molds for the second to fourth presses 5-2, 5-3, and 5-4.

According to an embodiment of the present invention, step S1 to step S5 may be performed on the second press 5-2 independently from the first press 5-1 while such steps S1 to S5 are performed on the first press 5-1. As such, the second press 5-2 may perform a pressing process and the process of exchanging grippers and press molds regardless of the pressing process or press mold/gripper exchanging process that the first press 5-1 performs. This is also true for the other downstream presses, e.g., the third and fourth presses 5-3 and 5-4.

For example, step S1 to step S5 may be performed on the third press 5-3 independently from the first press 5-1 and/or the second press 5-2 while such steps S1 to S5 are performed on the first press 5-1 and/or the second press 5-2.

For example, step S1 to step S5 may be performed on the fourth press 5-4 independently from the first press 5-1, the second press 5-2, and/or the third press 5-3 while such steps S1 to S5 are performed on the first press 5-1, the second press 5-2, and/or the third press 5-3.

As described above, exchanging press molds and/or grippers may be performed simultaneously on all of the presses or individually on each press when the entire production line remains in stop as well as in operation.

While the inventive concept has been shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A method for exchanging press molds and grippers in an automatic press-molded article manufacturing system using a double robot line for a tandem press line, the method comprising the steps of:

receiving, from a controller, an exchange signal to change a first press mold and a first gripper;

stopping a gripping task for carrying a raw material and a pressing process performed on a first raw material according to the exchange signal;

automatically changing the first gripper to a second gripper;

automatically changing the first press mold to a second press mold simultaneously with changing the first gripper to the second gripper;

transferring a second raw material using the second gripper; and performing a pressing process on the second raw material using the second press mold, wherein the system includes a first press, a second press positioned behind the first press, and a third press positioned behind the second press, wherein the steps by the second press are performed independently from the steps by the first press, and the steps by the third press are performed independently from the steps by the first press and the steps by the second press, and wherein the pressing processes, the step of changing the first press mold to the second press mold, and the step of changing the first gripper to the second gripper are continuously performed through the first press, the second press, and the third press, wherein the step of changing the first gripper to the second gripper includes the steps of:

moving down a robot safety door attached to a rotating table with the second gripper;

moving a raw material supply robot with the first gripper to the rotating table;

attaching the first gripper to the rotating table and then removing the first gripper from the raw material supply robot;

after attaching the second gripper to the raw material supply robot, disconnecting the second gripper from the rotating table;

moving the raw material supply robot with the second gripper to a position for the gripping task; and moving up the robot safety door.

2. The method of claim 1, wherein the step of changing the first press mold to the second press mold includes the steps of:

after moving down a slide of one of the first press, the second press, and the third press, releasing a mold fastening clamp for the first press mold;

moving up a press safety door;

pulling the first press mold out of a mold exchanger while putting the second press mold in the mold exchanger;

fastening the second press mold with the mold fastening clamp while moving up the slide; and moving down the press safety door.

3. The method of claim 2, wherein the step of changing the first press mold to the second press mold for the first press having a die cushion includes the steps of:

discharging air from the die cushion of the first press between the step of releasing the mold fastening clamp and the step of moving up the press safety door; and putting air in the die cushion of the first press between the step of fastening with the mold fastening clamp and the step of moving up the press safety door.

4. The method of claim 1, wherein carrying the raw material is performed simultaneously with the step of fastening with the mold fastening clamp.

* * * * *